United States Patent [19]

Mutsaarts

[11] Patent Number: 5,076,476

[45] Date of Patent: Dec. 31, 1991

[54] METHOD FOR CONTROLLING A FLOW RATE IN A VALVE AND A VALVE FOR THE APPLICATION OF SAID METHOD

[75] Inventor: Philippe Mutsaarts, Obourg, Belgium

[73] Assignee: Societe Belge Des Produits Refractaires, Bruxelles, Belgium

[21] Appl. No.: 544,056

[22] Filed: Jun. 26, 1990

Related U.S. Application Data

[63] Continuation of Ser. No. 361,054, Jun. 5, 1989, abandoned.

[30] Foreign Application Priority Data

Jun. 9, 1988 [EP] European Pat. Off. ..... 88870106

[51] Int. Cl.[5] ..... B22D 41/26

[52] U.S. Cl. ..... 222/590; 222/600

[58] Field of Search ..... 222/590, 600, 591, 597; 266/45, 236

[56] References Cited

U.S. PATENT DOCUMENTS 4,601,416 7/1986 Schiltknecht et al. ..... 222/600

4,896,801 1/1990 Lothmann et al. ..... 222/590

FOREIGN PATENT DOCUMENTS 0346258 4/1989 European Pat. Off. .

2085126 4/1982 United Kingdom ..... 222/600

2160804 1/1986 United Kingdom ..... 222/600

*Primary Examiner*—S. Kastler

*Attorney, Agent, or Firm*—Cushman, Darby & Cushman

[57] ABSTRACT

A method for controlling a flow rate of a liquid in particular of a molten material between a maximum flow and a zero flow, in a valve (1) comprising at least a fixed plate (2) and a mobile plate (3) which are superposed and maintained constantly in contact, each one having at least an opening (4, 5), said method, consisting of placing said openings (4, 5) more or less opposite each other by displacing said mobile plate (3) and wherein said mobile plate (3) is displaced according to at least two secant directions (6 and 7) which are determined for placing said openings (4, 5) of said fixed (2) and mobile plates (3) at least partly opposite each other when said valve is opened, and a valve for the application of said method.

17 Claims, 3 Drawing Sheets

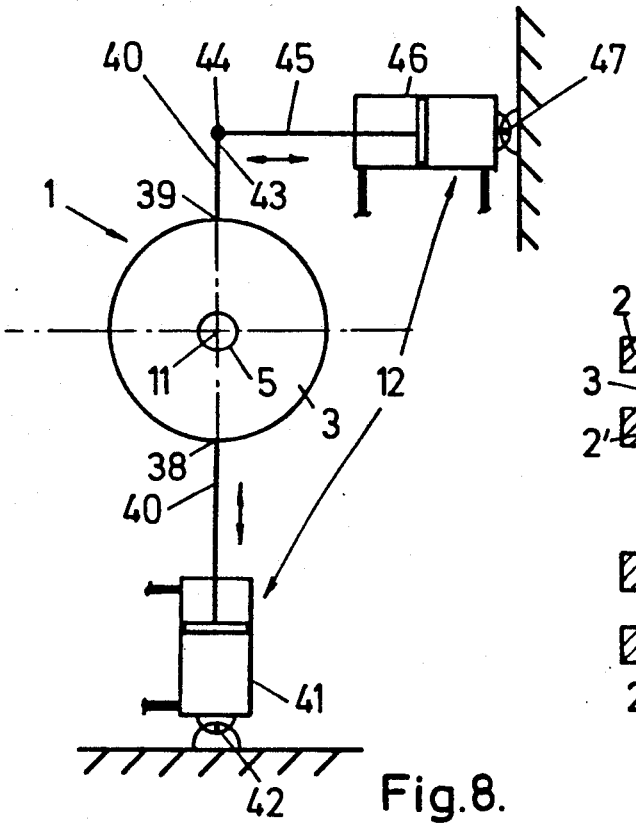
Fig.8.
Fig.10.
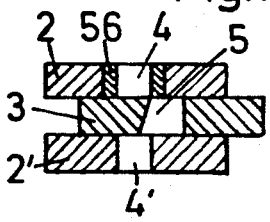
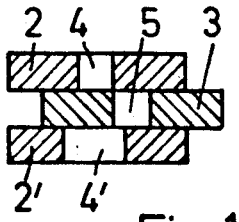
Fig.11.
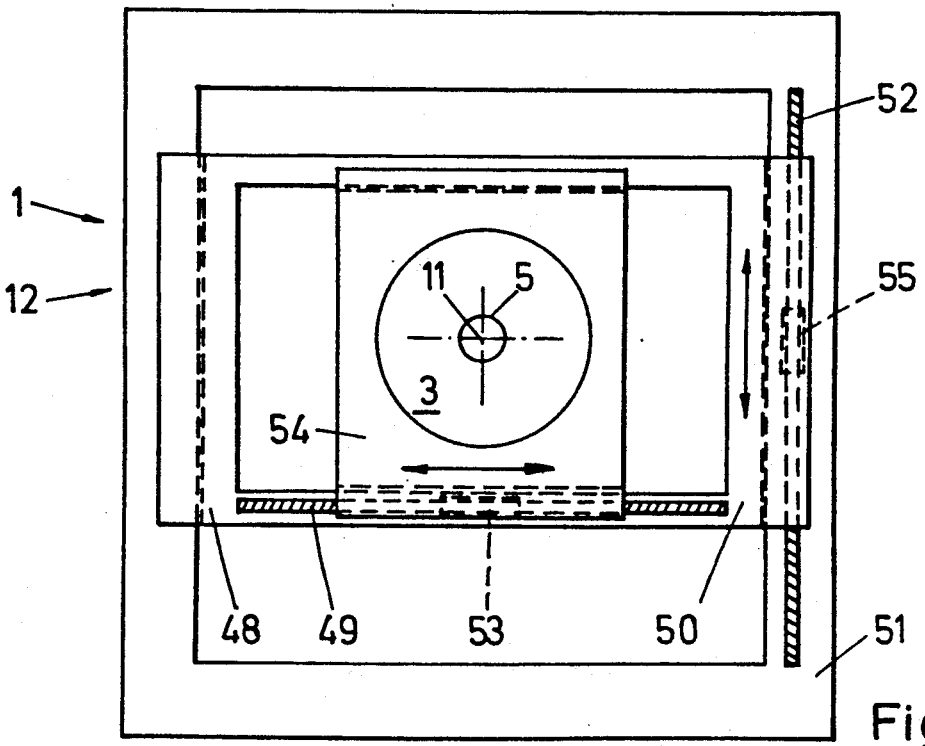
Fig.9.

METHOD FOR CONTROLLING A FLOW RATE IN A VALVE AND A VALVE FOR THE APPLICATION OF SAID METHOD

This is a continuation of application Ser. No. 07/361,054, filed on June 5, 1989, which was abandoned upon the filing hereof.

BACKGROUND OF THE INVENTION

The present invention relates to a method for controlling a flow rate of a liquid, in particular of a molten material, between a maximum flow and a zero flow, in a valve comprising at least a fixed plate and a mobile plate which are superposed and maintained constantly in contact with each other, each one presenting at least an opening, said method consisting of placing said openings more or less opposite to each other by displacing said mobile plate.

The actually known valves or stop-valves, particularly those applied in the metallurgy and especially in continuous casting, are divided into two types, namely a first valve type, the mobile plate of which is moved in two senses according to a rectilinear direction for forming a slide system and a second valve type the mobile plate of which is provided for being moved according to a circular motion for putting in both senses its opening or openings opposite or aside of an opening present in the fixed plate.

First these known valves or stop-valves, whatever their type may be, have the disadvantage of causing, when moving the mobile plate and especially when moving it for reducing or interrupting the liquid jet, a wear which is located on a relatively reduced part of the border of the opening of the mobile plate which, on the one hand obliges to increase the amplitude of the movement of the mobile plate for a given flow rate when the degree of the wear increases and, on the other hand, which has for consequence an increasing deviation of the jet resulting in an increase of the turbulences and an enhancement of deposits of chemical compounds and/or of solidified metal under the fixed plate and in the collector gas-nozzle cooperating with the opening of the latter, with the result that the disturbances of the jet are further increased and this until the interruption of the latter.

Although, it has been already considered to displace the mobile plate in both senses of the rectilinear (slide) or circular directions (rotary type) to cope with said disadvantage, it is however not possible with respect to the path followed by the mobile plate, to spread the wear over the whole periphery of the opening or the openings of said mobile plate.

Consequently, the two known valve types require to replace the mobile plates, which are expensive components, even as to interrupt the operation of the device for replacing the valve involving considerable costs whereas said mobile plates are only partly worn or degraded.

Moreover, said valves have other serious drawbacks, more particularly: considerable degradation risks due to tensions which are not homogeneous owing to the irregular heating of different masses, irregularly distributed around the opening of the mobile plate and eventually of the fixed plate; degradation risks due, for the same reason, to the different heat losses within the plates and finally, degradation risks due to local heatings in extremely reduced zones of the mobile plate, and always in the same zones.

SUMMARY OF THE INVENTION

It is an object of the present invention to provide a solution to these drawbacks and to provide a method enabling to distribute the wear regularly over at least an important part of the periphery of the opening of the mobile plate of the valve in order to increase its lifetime as well as particularly improving the qualities of the jet and eliminating the disadvantages due to the disturbances of the latter, with the important possibility to vary the heated zones continuously or discontinuously.

To this end, the method according to the invention consists in displacing said mobile plate according to at least two secant directions which are determined for placing said openings of said fixed and mobile plates at least partly opposite each other when said valve is opened.

The invention relates also to a valve in the plates of which the tensions are homogeneous, said plates having moreover the advantage to give an equilibrated heat distribution.

According to the invention at least said mobile plate of said valve is symmetrical with respect to at least a plane going through an axis of its opening.

Advantageously, according to the invention, said fixed and mobile plates of said valve are identical which reduces in a considerable manner the fabrication and the exploitation costs.

Other details and particularities of the invention will be explained with respect to the accompanying drawings which illustrate in a non limitating way said method by showing particular embodiments of the valve according to the invention.

BRIEF DESCRIPTION OF THE DRAWINGS

FIGS. 8 and 9 illustrate two variants of the valves shown in the FIGS. 5 to 7.

FIGS. 10 and 11 show details from the plates equiping the valves according to the invention.

In the different figures the same reference numbers indicate identical or analogous elements.

DETAILED DESCRIPTION OF THE INVENTION

Figure 1:
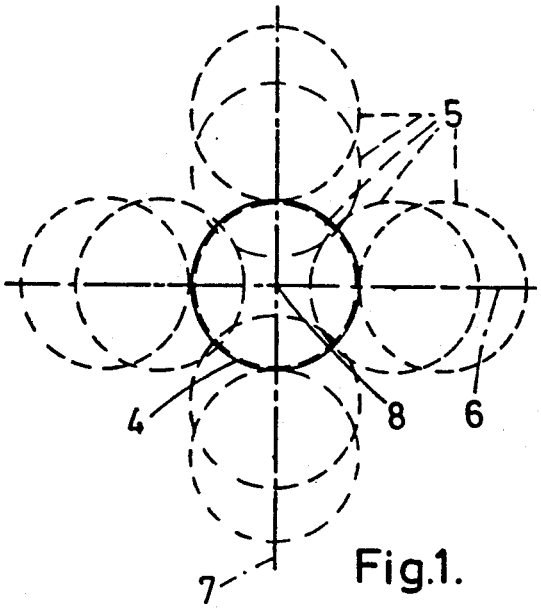
FIG. 1 is a schematic view illustrating said method and showing the four extreme positions and some intermediate positions which can be taken by the opening of the mobile plate when the latter is moved according to secant, rectilinear directions which are perpendicular and which cross the axis of the opening of the fixed plate, said latter opening being shown in full lines whereas the opening of the mobile plate is shown in dashed lines.

The method according to the invention and illustrated in the drawings is intended to control a flow rate of a liquid, more particularly of a molten material especially in a continuous casting unit, between a maximum flow and a zero flow by using a valve 1 comprising at least a fixed plate 2 and a mobile plate 3, which plates 2 and 3 are superposed and maintained constantly in contact, each one presenting an opening 4 (for the fixed plate) and 5 (for the mobile plate). According to the invention there may also be provided that the mobile plate 3 is disposed between an upper 2 and lower 2' fixed plate in order to be in contact with each one of the latter, the openings 4 and 4' of the fixed plates being coaxial and having either identical sections (see FIG. 10) or different sections (see FIG. 11). In the latter case, the opening 4' of the fixed plate 2' has a larger section than the one of opening 4 of the fixed plate 2 in order that the liquid kept in opening 5 of the mobile plate 3, the section of which being identical to the one of opening 4 of the fixed plate 2, can escape through the opening 4' after closing the valve. This feature is important when use is made of the valve for the flow of molten metal, because it avoids that the metal in the opening 5 of the mobile plate 3 solidifies after closing the valve and makes the latter unusable during the following opening of the valve, owing to the plug created in said opening 5. As shown in FIG. 10, the same result may be obtained by using two fixed plates 2 and 2', the openings 4 and 4' of which having the same section. To allow the liquid kept in the opening 5 of the mobile plate 3 to flow out from the latter after closing the valve, an opening 5 is thus provided, the aperture of which being directed towards the plate 2 has an area equal to the one of opening 4 of the plate 2' whereas its aperture being directed towards the plate 2' has an area larger than the one of opening 4' of the fixed plate 2'. According to the invention, several openings can be provided for each plate, for example two openings for each plate, said fixed and mobile plates being for example identical in order to be interchangeable and thus reducing the production cost. In this case either, alternately the two openings of the mobile plate or one of said two openings insofar as it usable and next the other one, will be used for each opening of the fixed plate on which the operation is performed. For carrying out the method according to the invention, plates 2, 2' and 3 which are symmetrical with respect to at least a plane going through the axes 8, 11 of their opening 4, 4' and 5, will preferably be used. In the examples described hereafter and illustrated in the drawings, only fixed and mobile plates which are identical and cylindrically shaped each with an opening, also cylindrically shaped and being coaxial to the plate, have been shown. These plates offer the advantage that the internal tensions, due to the heating are homogeneous and that the thermal losses within the plates are equilibrated. However, good results would be also obtained with square plates or plates having the shape of regular polygons provided that their opening is centred with respect to the plate.

To distribute the wear of the mobile plate 3 over a larger portion of the periphery of the opening 5 of said plate by doubling said portion with respect to the portion used in the known stop-valves, the method according to the invention consists in displacing, as shown in FIG. 1, said mobile plate 3 according to two rectilinear, secant directions diagrammatized by the strokes 6 and 7 and determined to place the openings 4 and 5 of the fixed 2 and mobile plate 3, partly or completely, opposite to each other during the opening of the valve 1. If it is desired to place the openings 4 and 5 completely opposite to each other, as is provided in the example illustrated in FIG. 1, at least one of the two directions 6 and 7 has to cross the axis 8 of the fixed opening 4. In FIG. 1, the two secant directions 6 and 7 are perpendicular but equivalent results would be obtained with rectilinear, secant, non perpendicular directions. A particularly equivalent result can be obtained by displacing the mobile plate 3 according to two secant directions, one of which is rectilinear, the other being circular. In this case the following various possibilities can be considered: the rectilinear direction 6 crosses the axis 8 of the opening 4 of the fixed plate and the centre 9 of the circular direction 7 is situated on said axis 8; the rectilinear direction 6 crosses the axis 8 of the opening 4 of the fixed plate 2 whereas the circular direction 7 does or does not cross said axis 8 and its centre 9 is situated within the projection on the mobile plate 3 of the opening 4 of the fixed plate 2; the rectilinear direction 6 crosses the axis 8 of the opening 4 of the fixed plate whereas the centre. 9 of the circular direction 7, which does or does not cross said axis 8, is situated outside the projection on the mobile plate 3 of the opening 4 of the fixed plate; the circular direction 7 crosses the axis 8 of the opening 4 of the fixed plate and its centre 9 is situated outside the projection on the mobile plate 3 of the opening 4 whereas the rectilinear direction does or does not cross said axis 8.

According to the invention, it is also possible to displace the mobile plate 3 in two secant, circular directions. In this way the wear of the mobile plate 3 will be distributed over the complete periphery of its opening 5 by displacing notably said plate 3 according to a first circular direction, the centre of which is situated on the axis 8 of the opening 4 of the fixed plate 2 and according to a second circular direction which crosses said axis 8.

Figure 2:
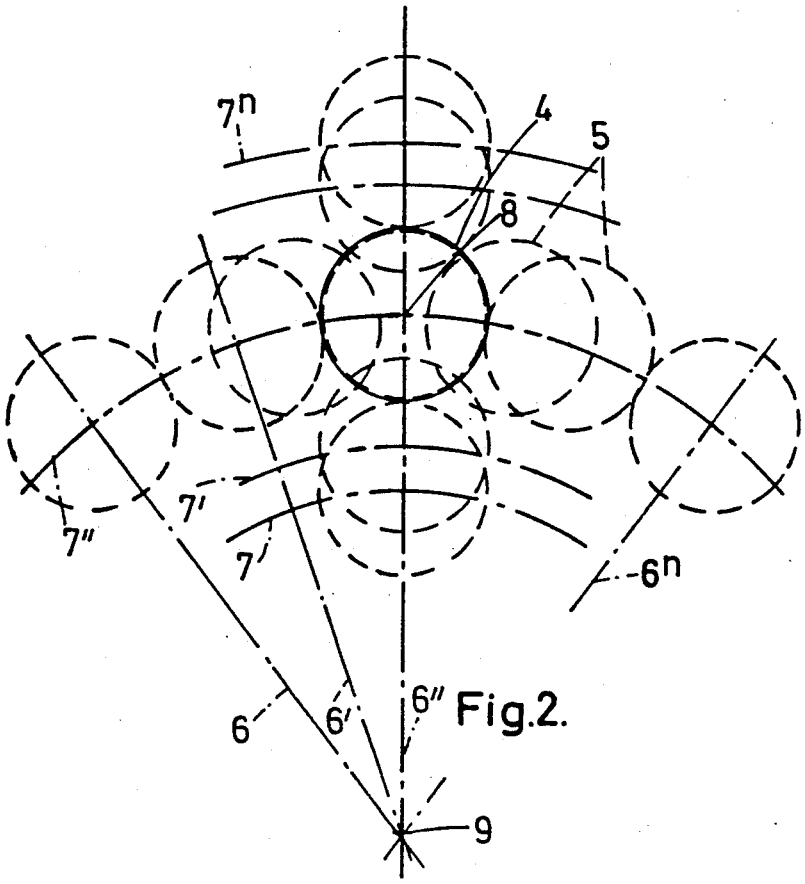
FIG. 2 is a schematic view showing some of the extreme and intermediate positions, which can be taken by the opening of the mobile plate when the latter is moved according to concentric, circular directions the centre of which is situated outside the projections on the mobile plate of the opening of the fixed plate and according to rectilinear directions going through said centre, one of said circular directions and one of said rectilinear directions crosses the axis of the opening of the fixed plate, the latter being shown in full lines whereas the opening of the mobile plate is shown in dashed lines.

The wear of the mobile plate 3 can also be distributed over the complete periphery of its opening 5 and this until the moment at which said plate 3 will maintain a sufficient resistance, by displacing it, as shown in FIG. 2, according to concentric circular directions 7, 7', 7'' . . . $7^n$ the centre 9 of which being situated outside the projection on the mobile plate 3 of the opening 4 of the fixed plate 2 and in rectilinear directions 6, 6', 6'' . . . $6^n$ passing through said centre 9, one of said circular directions and one of said rectilinear directions crossing axis 8 of the opening 4 of the fixed plate 2 so that the opening 5 of the mobile plate can be placed completely opposite to said opening 4.

Figure 3:
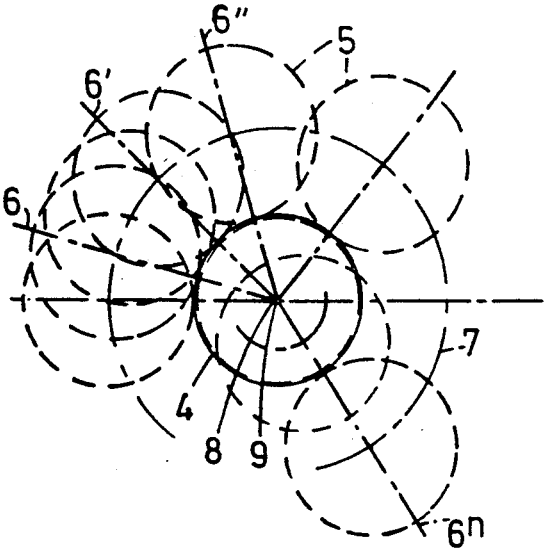
FIG. 3 is a view analogous to FIGS. 1 and 2 showing various positions which can be taken by the opening of the mobile plate when the latter is displaced according to concentric, circular directions the centre of which is situated on the axis of the opening of the fixed plate and according to rectilinear directions going through said centre.

A similar possibility of maximum use of the mobile plate 3 can be realized, as shown in FIG. 3, by displacing said mobile plate 3, on the one hand according to concentric circular directions 7, 7' . . . the centre 9 of which being situated on axis 8 of the opening 4 of the fixed plate 2 and, on the other hand according to rectilinear directions 6, 6' . . . $6^n$ passing through said centre 9 of the circular directions.

Figure 4:
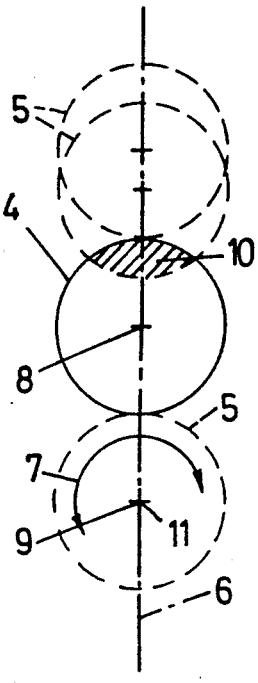
FIG. 4 is a view analogous to the previous Figures and shows various positions which can be taken by the opening of the mobile plate when the latter is displaced according to a rectilinear direction crossing the axis of the opening of the fixed plate and according to a circular direction the centre of which is situated on the axis of the opening of the mobile plate.
Figure 7:
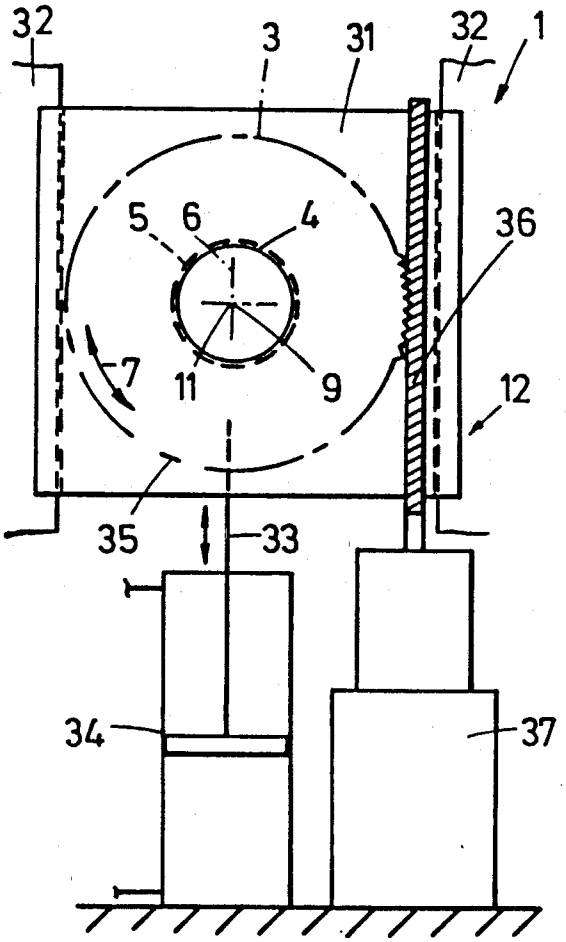
FIG. 7 is also a view analogous to FIGS. 5 and 6 of a valve, the mobile plate of which is displaced according to the directions defined in FIG. 4.

The method according to the invention allows, when the openings 4 and 5 of the fixed and mobile plates are not completely facing each other so as to throttle the jet, in a slide system, as shown in FIGS. 4 and 7, just as in the system as illustrated in FIG. 9 and which will be described hereinafter, to change the zone 10 of the mobile plate in contact with the molten metal step by step or continuously and this in such a manner as to obtain a better balancing of the tensions in the mobile plate.

In the embodiment of the method shown in FIG. 4, the mobile plate 3 is displaced in a rectilinear direction 6 crossing the axis 8 of the opening 4 of the fixed plate 2 and according to a circular direction 7, secant to direction 6 and having its centre 9 situated on the axis 11 of the mobile plate 3.

It is clear that said rotation of the mobile plate 3 around the axis 11 of its opening 5 can be combined with all the movements in the directions described hereabove, and more particularly with the movements in the rectilinear directions 6 and 7 illustrated in FIG. 1.

The displacements of the mobile plate 3 according to said directions can be programmed either to be effectuated simultaneously or to be effectuated successively in a whether or not determined order, moreover said displacements can be effectuated for certain or all of said directions in both senses.

The valve 1 according to the invention is schematically shown, in FIGS. 5 to 9, either by its fixed 2 and mobile plate 3 and by its means 12 enabling to displace the mobile plate 3 according to said at least two secant directions 6 and 7, or by the axis 8 of the opening 4 of the fixed plate 2, by the mobile plate 3 and by said means 12.

Figure 5:
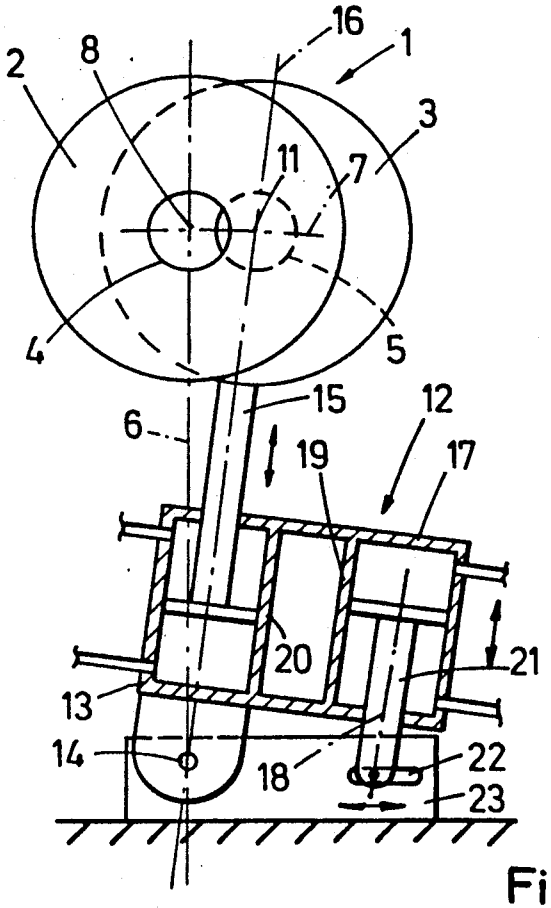
FIG. 5 is a schematic view of the mobile plate of a valve according to the invention and of means enabling the displacements of said plate according to the directions defined in FIG. 2, the opening of the fixed plate being shown in dashed lines.

The valve 1, shown in FIG. 5, is provided with means 12 enabling to displace the mobile plate 3 according to rectilinear directions 6, 6' . . . $6^n$ and according to concentric, circular directions 7, 7' . . . $7^n$ as described hereabove and illustrated in FIG. 2. Said means 12 are on the one hand, composed of a first jack 13, rotatably mounted on a fixed axis 14, parallel with the axis 11 of the opening 5 of the mobile plate 3, the free end of the piston rod 15 carries the mobile plate 3 so that the axis 16 of the jack 13 crosses the axis of the opening 5 of the mobile plate 3 and, on the other hand, of a second jack 17, the axis 18 of which is parallel to the axis 16 of the jack 13, the cylinder 19 of which is fixed to the cylinder 20 of said jack 13, which has its free end of its piston rod 21 displacing in a horizontal button-hole 22 made in a fixed piece 23.

Figure 6:
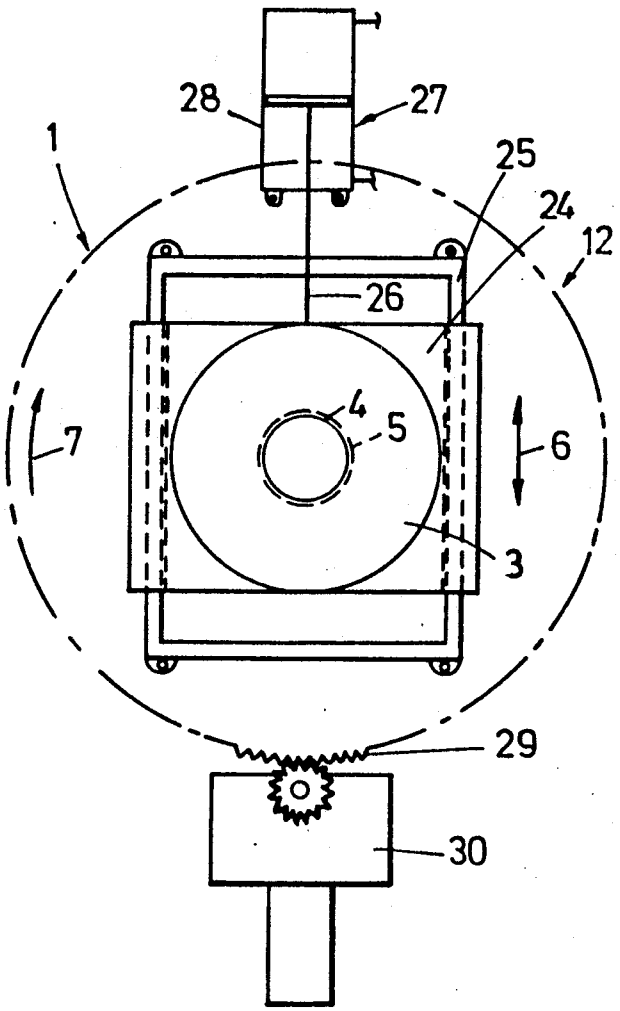
FIG. 6 is a view analogous to FIG. 5 and shows the mobile plate of a valve as well as the drive means of the latter which are provided for displacing said plate according to the directions defined in FIG. 3.

The valve 1, shown in FIG. 6, is provided with means 12 enabling to displace the mobile plate 3 in rectilinear directions 6, 6' . . . $6^n$ and in concentric circular directions 7, 7' . . . $7^n$ such as described hereabove and shown in FIG. 3. Said means 12 comprise a slide 24 in which the mobile plate 3 is fixed and which is mounted in such a manner in a frame 25 having the shape of a rectangle, that it can be displaced parallel to itself. Said slide 24 is fixed to the end of the piston rod 26 of a jack 27, the axis of which crosses the axis of the opening 5 of the mobile plate 3 and is parallel to one of the sides of the frame 25. Said frame 25 and the cylinder 28 of the jack 27 are fixed to circular crown-wheel 29 the axis of which being parallel to the axis of the opening 5 of the mobile plate 3 or coincide with said latter axis, depending on the position of the slide 24 with respect to the frame 25 with which it cooperates. A fixed engine with a reducer 30 is provided to drive around its axis the crown-wheel 29 as well as the frame 25 and the jack 27, which are fixed thereto.

FIG. 7 shows a valve 1 according to the invention provided with means 12 which enable to displace the mobile plate 3 according to the rectilinear direction 6 crossing the axis 11 of the opening 5 of the mobile plate 3 and according to a circular direction 7 the centre 9 of which is situated on said axis 11 (see FIG. 4). Said mobile plate 3 is mounted on a support 31 so arranged that the mobile plate 3 can rotate freely around said axis 11. The support 31 is slidably mounted on a support 32 on which it can be displaced freely and parallel to itself in said rectilinear direction 6 and operated by the piston rod 33 of a fixed jack 34, the axis of which is perpendicular to the axis 11 of the opening 5. A toothed crown-wheel 35 cooperates with the circumference of the mobile plate 3 and is coaxial with the opening 5, an endless screw worm 36 parallel to to direction 6 and controlled by an engine with a reducer is provided to drive into rotation the crown-wheel, and the mobile plate 3 fixed thereto, around the axis 11.

The valve 1 represented in FIG. 8 is a variant of the valve illustrated in FIG. 5. The mobile plate 3 is fixed, in 38 and 39, to the piston rod 40 of a jack 41, the cylinder of which is pivotably mounted on a fixed axis 42 parallel to the axis 11 of the opening 5 of the mobile plate 3, the axis of the jack 41 being perpendicular to said axis 11. The end 43 of the piston rod 40 is hingedly connected in 44 around an axis parallel to the axis 11, at the free end of the piston rod 45 of a jack 46, the cylinder of which is pivotably mounted to a fixed axis 47, parallel to the axis 11.

The valve 1 illustrated in FIG. 9, has a mobile plate 3 the displacements of which are realized by means 12 comprising a first frame 48, having the shape of a rectangle, on one of the sides of which there is mounted an endless screw worm 49 arranged so as to displace the mobile plate 3 in the first frame 48 thanks to a nut 53 fixed to the support 54 of plate 3 in a direction parallel to this side 50. Said frame 48 is mounted in a second fixed frame 51 having the shape of a rectangle, on one of the sides of which there is mounted an endless screw worm 52 arranged to displace the frame 48 in the frame 51 thanks to a nut 55 fixed to the frame 48 according to a direction perpendicular to said side 50 of said frame 48, the axis of the worms 49 and 52 being perpendicular. For varying said zone 10 of the mobile plate 3 in contact with the molten metal, either step by step or continuously, in a similar way as the one shown in FIGS. 4 and 7, the mobile plate 3 may rotate in its support 54 around the axis 11 of its opening 5. When the valve is used for molten metal, a porous insert 56 is advantageously provided, as shown in FIG. 10, in at least one of the plates 2, 2' and 3, through which insert gas, such as argon, can circulate under pressure. Said insert, in which a non represented gas supply pipe ends, surrounds the opening of the plate over at least an important part of its thickness. Advantageously the mobile plate 3 used in said valves, will be encircled by a metal casing provided with connection parts connected to said means 12 assuring the displacements of said mobile plate 3.

It is to be understood that the invention is by no way limited to the above described embodiments and that many modifications can be brought to the latters without leaving the scope of the present patent.

What is claimed is:

1. A method for controlling a flow rate of a liquid between a maximum flow and a zero flow, in a valve comprising at least a fixed plate and a mobile plate which are superposed and constantly maintained in contact, each said plate having at least one opening defined therethrough, and means for displacing said mobile plate relative to said fixed plate so as to displace a particular opening of said mobile plate selectively along a plurality of paths, at least two of said paths intersecting a particular opening of said fixed plate so that said particular opening of said mobile plate can be selectively at least partially superposed with said particular opening of said fixed plate by displacing said particular opening of said mobile plate along any of said at least two of said plurality of paths, said method comprising opening the valve by placing said particular opening of said mobile plate at least partially in facing relation to said particular opening of said fixed plate by displacing said particular opening of said mobile plate along at least two of said plural paths, at least one of said at least two paths along which said particular opening of said mobile plate is displaced intersecting said particular opening of said fixed plate in order to at least partially superpose the opening of said mobile plate and the opening of said fixed plate, said mobile plate being displaced, on the one hand according to two rectilinear paths, at least one of which crosses an axis of said opening of said fixed late and, on the other hand, according to a circular path a center of which is situated on an axis of said opening of said mobile plate.

2. A method for controlling a flow rate of a liquid between a maximum flow and a zero flow, in a valve comprising at least a fixed plate and a mobile plate which are superposed and constantly maintained in contact, each said plate having at least one opening defined therethrough, and means for displacing said mobile plate relative to said fixed plate so as to displace a particular opening of said mobile plate selectively along a plurality of paths, at least two of said paths intersecting a particular opening of said fixed plate so that said particular opening of said mobile plate can be selectively at least partially superposed with said particular opening of said fixed plate by displacing said particular opening of said mobile plate along any of said at least two of said plurality of paths, said method comprising opening the valve by placing said particular opening of said mobile plate at least partially in facing relation to said particular opening of said fixed plate by displacing said particular opening of said mobile plate along at least two of said plural paths, at least one of said at least two paths along which said particular opening of said mobile plate is displaced intersecting said particular opening of said fixed plate in order to at least partially superpose the opening of said mobile plate and the opening of said fixed plate, at least one of said plural paths being rectilinear and at least another of said plural paths being circular, said mobile plate being displaced according to a rectilinear path crossing an axis of said opening of said fixed plate and according to a circular path a center of which is situated on an axis of said opening of said mobile plate.

3. A valve for controlling a flow rate of a liquid between a maximum flow and a zero flow, comprising at least a fixed plate and a mobile plate which are superposed and constantly maintained in contact, each of said plates having at least one opening defined therethrough to be placed at least partially in facing relation to each other for opening said valve, and means for displacing said mobile plate relative to said fixed plate so as to displace a particular opening of said mobile plate selectively along a plurality of paths, at least two of said paths intersecting a particular opening of said fixed plate so that said particular opening of said mobile plate can be selectively at least partially superposed with said particular opening of said fixed plate by displacing said mobile plate along any of said at least two of said plurality of paths, said mobile plate and said fixed plate being symmetrical with respect to at least one plane going through an axis of their opening, at least one of said plates comprising a porous insert provided for enabling the circulation of a gas and which insert is sunk in said plate over at least an important part of its thickness, around an opening of said one plate, a supply pipe for gas being provided to supply gas to said insert.

4. A method for controlling a flow rate of a liquid between a maximum flow and a zero flow, in a valve comprising at least a fixed plate and a mobile plate which are superposed and constantly maintained in contact, each said plate having at least one opening defined therethrough, and means for displacing said mobile plate relative to said fixed plate so as to displace a particular opening of said mobile plate selectively along a plurality of paths, at least two of said paths intersecting a particular opening of said fixed plate so that said particular opening of said mobile plate can be selectively at least partially superposed with said particular opening of said fixed plate by displacing said particular opening of said mobile plate along any of said at least two of said plurality of paths, said method comprising opening the valve by placing said particular opening of said mobile plate at least partially in facing relation to said particular opening of said fixed plate by displacing said particular opening of said mobile plate along at least two of said plural paths, at least one of said at least two paths along which said particular opening of said mobile plate is displaced intersecting said particular opening of said fixed plate in order to at least partially superpose the opening of said mobile plate and the opening of said fixed plate, two of said plurality of paths according to which said mobile plate is displaced, being circular.

5. A valve for controlling a flow rate of a liquid between a maximum flow and a zero flow, comprising at least a fixed plate and a mobile plate which are superposed and constantly maintained in contact, each of said plates having at least one opening defined therethrough to be placed at least partially in facing relation to each other for opening said valve, and means for displacing said mobile plate relative to said fixed plate so as to displace a particular opening of said mobile plate selectively along a plurality of paths, at least two of said paths intersecting a particular opening of said fixed plate so that said particular opening of said mobile plate can be selectively at least partially superposed with said particular opening of said fixed plate by displacing said mobile plate along any of said at least two of said plurality of paths, said means for displacing said mobile plate including means for rotating said mobile plate about a central axis thereof.

6. A method as claimed in claim 4, wherein said mobile plate is displaced in a direction defined by said two of said plural paths.

7. A valve as claimed in claim 5, wherein said mobile plate is mounted in a first frame having a rectangular shape and comprising an endless screw worm for displacing said mobile plate within said first frame in a direction parallel to a side of said first frame, the latter being mounted in a second fixed frame, having a rectangular shape and comprising an endless screw worm for displacing said first frame within said second frame according to a direction parallel to one of its sides an axis of latter endless screw worm being substantially perpendicular to an axis of said endless screw provided on said first frame.

8. A valve as claimed in claim 5, wherein said mobile plate is fixed on a piston rod of a first jack, the cylinder of which being rotatably mounted on a fixed axis parallel to further axis of said opening of said mobile plate, a second jack being coupled to said first jack for enabling an oscillation of a cylinder of the latter around said fixed axis on which it is rotatably mounted.

9. A valve as claimed in claim 5, wherein said mobile plate is fixed on a slide mounted in a frame having a rectangular shape said slide being fixed to a piston rod of a jack, an axis of which crosses a further axis of said opening of said mobile plate and which is parallel to one of the sides of said frame, the latter and the cylinder of the jack being fixed to a circular crown-wheel an axis of which being parallel to said further axis of said opening of said mobile plate or coincide with said further axis depending on the position of said slide with respect to said frame, said circular crown-wheel being supported in such a manner to be able to rotate around its axis and a fixed engine with a reducer being provided for enabling a rotation of said crown-wheel around its axis.

10. A valve as claimed in claim 5, wherein said mobile plate is mounted on a support which is provided for enabling a free rotation of said plate around an axis of its opening, said support being mobile and mounted on means, such as a piston rod of a jack, a cylinder of which being fixed and which jack is provided for displacing said plate in a rectilinear direction going through said axis of said opening of said mobile plate, said valve comprising a toothed crown-wheel so coupled to said mobile plate that is coaxial to said opening of the latter, and means provided for engaging with said crown-wheel for enabling a rotation around its axis.

11. A valve as claimed in claim 5, wherein said mobile plate and said fixed plate are symmetrical with respect to at least one plane going through an axis of their opening.

12. A valve as claimed in claim 11, wherein said mobile plate has the shape of a cylinder, an opening of said plate being coaxial to said cylinder and preferably said opening has on the one hand the shape of a cylinder and has, on the other hand a comparable shape and a comparable section to said opening of said fixed plate.

13. A valve as claimed in claim 12, wherein said fixed and mobile plates are identical.

14. A valve as claimed in claim 5, wherein said mobile plate is slidable between an upper and a lower fixed plate the openings of which having a comparable section, an opening of said mobile plate having an aperture oriented towards said upper fixed plate having an area substantially equal to the one of the section of said opening of said upper fixed plate and smaller than the area of its aperture directed towards said lower fixed plate.

15. A valve as claimed in claim 5, wherein said mobile plate is slidable between an upper and a lower fixed plate an opening of said upper fixed plate and an opening of said mobile plate having comparable section whereas a opening of said lower fixed plate has a section superior to the section of said openings of said upper fixed plate and said mobile plate.

16. A method as claimed in claim 4, wherein said at least paths two are determined in such a manner that at least one of those crosses an axis of said opening of said fixed plate.

17. A method as claimed in claim 4, wherein a center of one of said circular paths is situated on an axis of said opening of said fixed plate and the other circular path crosses said axis.

* * * * *